US005855172A

United States Patent [19]

Corrado et al.

[11] Patent Number: 5,855,172

[45] Date of Patent: Jan. 5, 1999

[54] CONTACT CLEANING ROLLER OSCILLATED BY A BARREL CAM

[75] Inventors: Frank C. Corrado; James W. Fischer, both of Rochester; Cary R. Larsen, Webster; Ronald W. Sweet, Conesus, all of N.Y.

[73] Assignee: SeraTek LLC, Livonia Center, N.Y.

[21] Appl. No.: 52,687

[22] Filed: Mar. 31, 1998

[51] Int. Cl.[6] ..... B41F 35/00

[52] U.S. Cl. ..... 101/423; 101/425

[58] Field of Search ..... 101/423, 425, 101/424, 348, DIG. 38

[56] References Cited

U.S. PATENT DOCUMENTS

| | | | |
|---|---|---|---|
| 705,631 | 7/1902 | Anthony | 101/DIG. 38 |
| 1,040,170 | 10/1912 | Dietrich | 101/337 |
| 1,457,252 | 5/1923 | Kaufman | 101/348 |
| 3,815,498 | 6/1974 | Harrod | 101/348 |
| 4,337,699 | 7/1982 | Beisel | 101/348 |
| 4,397,236 | 8/1983 | Greiner et al. | 101/350 |
| 4,809,606 | 3/1989 | Day et al. | 101/148 |
| 5,351,614 | 10/1994 | Depa | 101/348 |
| 5,495,801 | 3/1996 | Dankert | 101/348 |
| 5,524,805 | 6/1996 | Shiba et al. | 101/425 |
| 5,611,281 | 3/1997 | Corrado et al. | 101/425 |

*Primary Examiner*—Edgar Burr
*Assistant Examiner*—Anthony H. Nguyen
*Attorney, Agent, or Firm*—R. C. Brown; M. Lukacher; K. Lukacher

[57] ABSTRACT

A contact cleaning roller (CCR) system includes a shell having an electrostatically active outer surface and being supported by a close-fitting rotatable shaft. The shaft within the shell is provided with a cam groove extending from a first axial location to a second axial location disposed 180° from the first axial location, and then back to the first axial location. A cam follower attached to the inner surface of the shell rides in the cam groove, causing the shell to oscillate axially of the shaft at a frequency of oscillation which is the numerical difference between the rotational frequencies of the shell and shaft. In a preferred embodiment, the CCR shell is nipped against a backing roller, which may be an idle roller or a driven roller, the web passing therebetween in contact with the working surfaces of both rollers. Outboard of the working surfaces, the shaft of the backing roller has a first drive roller having a first diameter, and the shaft of the barrel cam has a second drive roller nipped against the first drive roller and having a second diameter slightly different from the first diameter. Thus, the CCR shell turns at a rotational frequency imposed by the linear velocity of the web whereas the CCR shaft turns at a different frequency as imposed by the relative diameters of the two speed-controlling drive surfaces, the frequency differential being equal to the oscillation frequency of the CCR shell along the barrel cam.

13 Claims, 5 Drawing Sheets

CONTACT CLEANING ROLLER OSCILLATED BY A BARREL CAM

The present invention relates to apparatus for removing particles from substrates, more particularly to contact cleaning rollers for cleaning particles of debris from substrate surfaces such as moving webs, and most particularly to a contact cleaning roller which is oscillated axially as it is rolled along a substrate surface to be cleaned.

U.S. Pat. No. 5,611,281 issued Mar. 18, 1997 to Corrado et al., which is hereby incorporated by reference, discloses a system for axially reciprocating a tacky roller (contact cleaning roller, or "CCR") across a substrate being cleaned by the roller. Such reciprocation is useful for spreading particles which may be non-uniformly distributed on the substrate surface over a broader area of the tacky roller collecting surface, thereby decreasing the rate of decay of collecting efficiency, improving the average cleanliness of the treated substrate, and extending the operating lifetime of the tacky roller between renewals. The CCR is mounted in a movable frame which is journalled in linear bearings and is displacable axially of the shaft by an actuator.

To avoid scratching or scrubbing of the substrate surface by the CCR while the roller is simultaneously rolling along the surface in a first direction and axially sliding across the surface in a second and orthogonal direction, the rate of axial displacement is preferably very low; that is, the ratio of axial to rotational linear velocities is preferably between about 0.01 and about 0.0001. In practice, therefore, the reciprocating actuator may be required to operate at about 1 cycle per minute (cpm) or even less. It can be expensive and difficult to provide an actuating system having the capability for such smooth, slow motion. Such a system may include an actuator, air or hydraulic supply, and an electronic controller having this capability. In addition, such a system is subject to unwanted variation from misadjustment, wear, and drift in electronic and pneumatic components. Thus there is a need for a simple, inexpensive, reliable, and invariant means for slowly oscillating a CCR axially while it is being rolled along a substrate surface.

It is a principal object of the invention to provide an improved means for axially oscillating a CCR at a fixed frequency of oscillation.

It is a further object of the invention to provide an improved means for axially oscillating a CCR whereby the frequency of oscillation may be readily changed as desired.

Briefly described, a CCR system embodying the invention includes a contact cleaning roller shell having an electrostatically active outer surface and being supported by a close-fitting rotatable shaft. The surface of the shaft within the shell is provided with a cam groove extending from a first axial location to a second axial location disposed 1800 from the first axial location, and then back to the first axial location to close the loop. A protrusion defining a cam follower is attached to the inner surface of the CCR shell and rides in the cam groove. Thus, when the shell is caused to rotate at a different rotational frequency than the shaft, the shell oscillates axially of the shaft at a frequency of oscillation which is the numerical difference between the rotational frequencies of the shell and shaft. Alternatively and with equal effect, the groove may be provided in the inner surface of the shell and the cam follower may be fixed to the shaft.

Such an arrangement is known as a "drum cam" or "barrel cam," as disclosed for various conventional roller applications, for example, in U.S. Pat. Nos. 1,040,170 issued Oct. 1, 1912 to Dietrich; 3,815,498 issued Jun. 11, 1974 to Harrod; 4,337,699 issued Jul. 6, 1982 to Beisel; 4,397,236 issued Aug. 9, 1983 to Greiner et al.; and 4,809,606 issued Mar. 7, 1989 to Day et al.

In one embodiment of the present invention, the CCR is disposed against a free span of a moving web being cleaned, the rotational frequency of the CCR shell being imposed by the linear velocity of the moving web. For example, a CCR having a 6-inch diameter and cleaning a web travelling at 1000 fpm has a rotational frequency of 637 rpm. When the shaft is driven at a rotational frequency of, for example, 636 rpm or 638 rpm, the CCR shell oscillates axially of the shaft at a frequency of 1 cpm.

In another embodiment of the present invention, the CCR shell is disposed in nip relationship against another ("backing") roller, the web substrate being cleaned passing therebetween and the rotational frequency of the CCR again being governed by the linear velocity of the web. Again, the shaft is driven at a rotational frequency slightly different from that of the CCR shell to cause the shell to oscillate axially of the shaft.

In a preferred embodiment, the CCR shell is disposed in nip relationship against a backing roller, which may be an idle roller or a driven roller, the web passing therebetween in contact with the working surfaces of the shell and the backing roller. The shell is thus caused to turn at a first frequency governed by the linear velocity of the web. Outboard of the working surfaces, the shaft of the backing roller is provided with a first speed-controlling cylindrical drive surface having a first diameter, and the shaft of the barrel cam is provided with a second speed-controlling cylindrical drive surface having a second diameter slightly different from the first diameter and nipped against the first speed-controlling surface. Thus, the shell turns at a rotational frequency imposed by the linear velocity of the web whereas the shaft turns at a different frequency as imposed by the relative diameters of the two speed-controlling drive surfaces, the frequency differential being equal to the oscillation frequency of the CCR shell along the barrel cam.

The foregoing and other objects, features, and advantages of the invention, as well as presently preferred embodiments thereof, will become more apparent from a reading of the following description in connection with the accompanying drawings in which.

Figure 1:
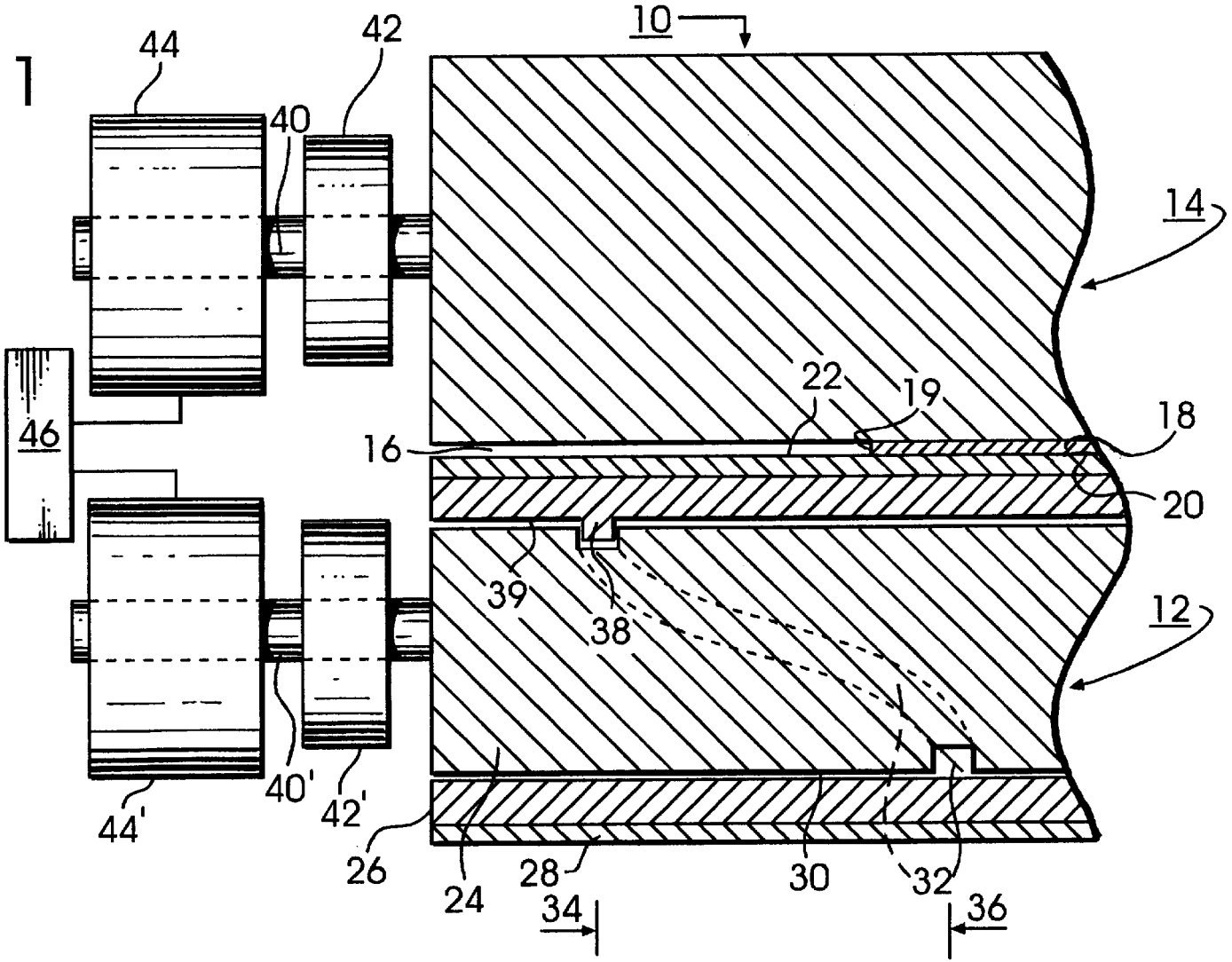
FIG. 1 is vertical cross-sectional view of a first embodiment in accordance with the invention taken through the axes of a barrel-cam contact cleaning roller and a backing roller, showing the CCR and backing roller being driven by independent drive means governed by an electronic controller.

Referring to FIG. 1, there is shown a first embodiment 10 in accordance with the invention comprising a contact cleaning roller assembly (CCR) 12 and a counter-rotatable backing roller 14 having a nip 16 for passage of a planar substrate 18 therebetween in a direction orthogonal to the plane of the drawing, the substrate having particles on surface 20 thereof and CCR 12 being so positioned as to remove and transfer the particles to its own outer surface 22 by rolling contact with substrate surface 20. Preferably, nip 16 is very slightly narrower than the thickness of substrate 18 to ensure continuous, pressured contact between the surface to be cleaned and the CCR. Backing roller 14 may be formed of any convenient material having high rigidity and capable of being finished to a high polish, for example, stainless steel or chrome-plated steel. The substrate 18, of which an edge 19 is shown in FIG. 1, may be formed of any material susceptible to particulate contamination removable by a CCR, for example, a continuous web of plastic resin or resin-coated paper, such as photographic support.

Figure 3:
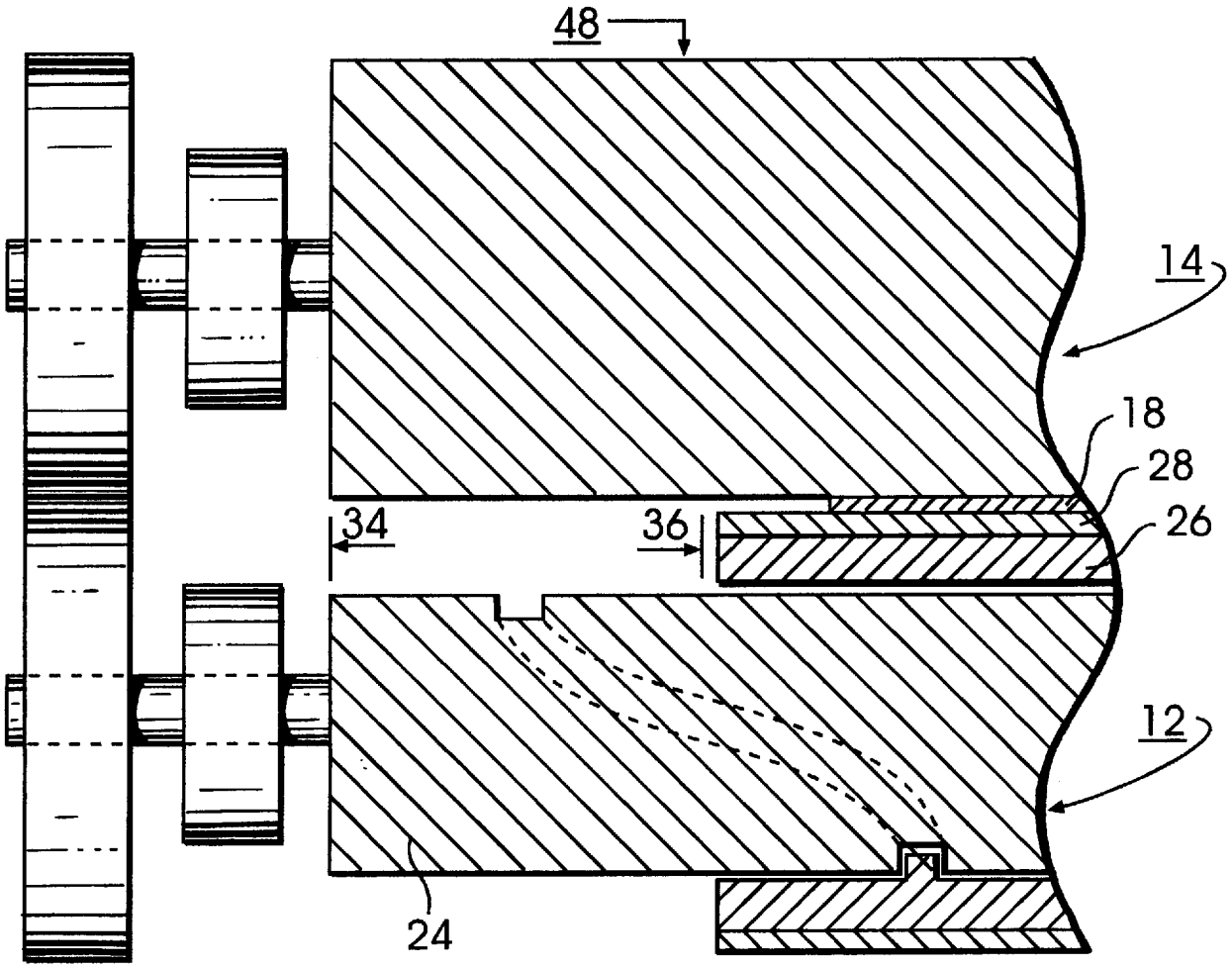
FIG. 3 is a view like that shown in FIG. 2, showing the CCR shell at a second and opposite extreme of axial oscillation.

CCR 12 is provided with a central shaft 24, a cylindrical shell 26 axially slidable on shaft 24, and an outer cover 28, bonded to shell 26, of electrostatically active material, for example, a polyurethane polymer, for attracting and holding particles. Shaft 24 is provided in its outer surface 30 with a continuous groove 32 which forms a closed loop extending around the entire circumference of shaft 24 between a first axial position 34 and a second axial position 36, groove 32 thus defining a cam. Shell 26 is provided with a protrusion 38 on inner surface 39, which protrusion extends into groove 32 to define a cam follower. The combination of shaft, shell, groove, and protrusion defines a barrel cam, whereby relative rotational motion between shaft 24 and shell 26 causes cam follower 38 to be forced along groove 32 in one direction or the other, which in turn causes shell 26 to be displaced axially of shaft 24. One complete rotation of the shell about the shaft must be accompanied by one complete axial oscillation of the shell along the shaft. (FIG. 3 shows the relationship of shell and shaft after one-half of one relative rotation between the shell and shaft.) Thus the rate or frequency of oscillation of the shell can be controlled absolutely by the rate or frequency of relative rotation between the shell and the shaft, and the length of oscillatory excursion is controlled by the axial distance between the first and second axial positions 34,36 of the groove.

Backing roller 14 and CCR shaft 24 are each provided with a shaft 40,40' respectively, which shafts are fixed to and rotate with their respective rollers. The shafts are journalled in bearings 42,42', respectively.

In first embodiment 10, each of shafts 40,40' is provided with an independently controllable drive means 44,44' connected to the output of an electronic controller 46, such that the rotational frequency of each of shafts 40 and 40' may be controlled as desired to control the rate of axial oscillation of shell 26.

Figure 2:
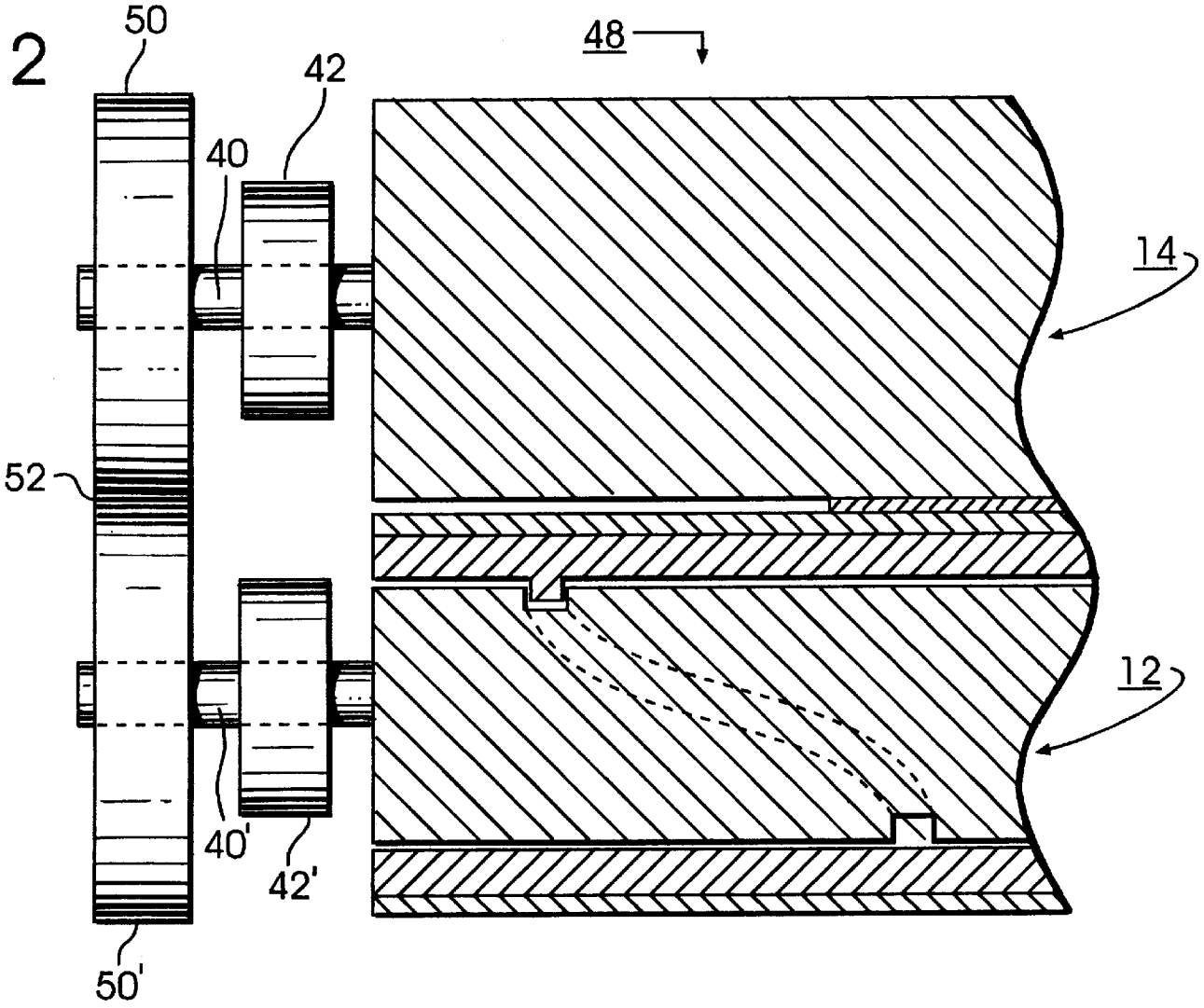
FIG. 2 is a view like that shown in FIG. 1, showing a second and preferred embodiment of drive apparatus for driving the barrel cam and the backing roller at different rotational frequencies in accordance with the invention, and showing the CCR shell an one extreme of axial oscillation.
Figure 4:
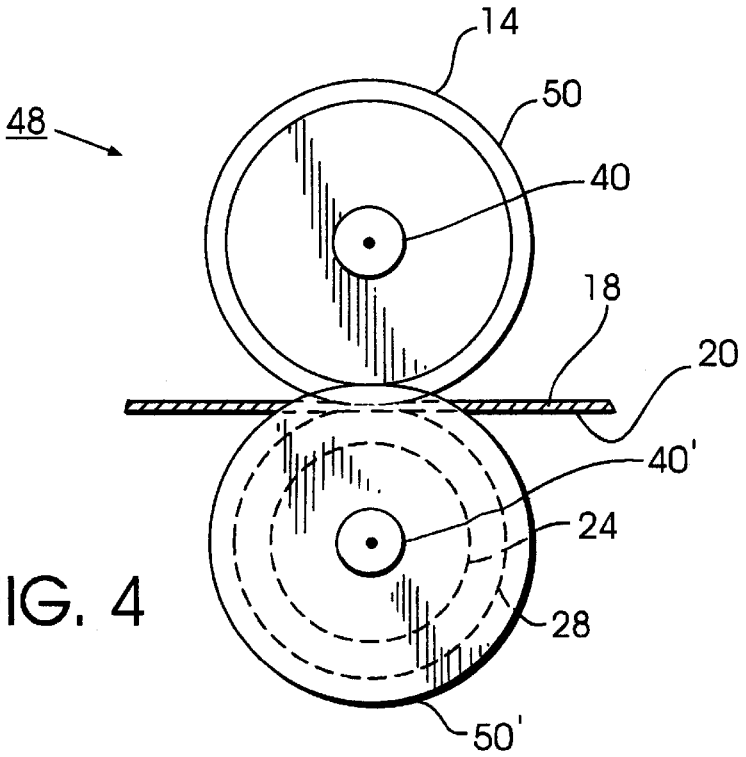
FIG. 4 is an elevational view of the left end of the embodiment shown in FIG. 2, showing a web being nipped between the CCR shell and the backing roller.

Referring to FIGS. 2–4, in a second embodiment 48 in accordance with the invention, each of shafts 40,40' is further provided outboard of the bearings 42, 42' with a cylindrical drive surface 50, 50' respectively in the form of two axially-short rollers which are nipped to be rolled in contact at second nip 52. (For clarity of presentation, bearings 42,42' are omitted from FIG. 4). For the drive rollers to be nipped properly, the sum of the diameters of the drive rollers must equal the sum of the diameters of the backing roller and the CCR plus the thickness of the substrate, as described more fully below. In practice, either of shafts 40 and 40' may be driven by any conventional drive means (not shown) to convey substrate 18 between the CCR and backing roller, or neither may be driven and both the CCR and the backing roller may be idle rollers. In any of these three mechanical configurations, for all conditions in which drive rollers 50 and 50' are of unequal diameters, the barrel cam will cause the CCR shell to oscillate axially of the CCR shaft at an oscillatory frequency dependent on the diameters and rotational frequency of each of the drive rollers. Thus, $$D_1F_1=D_3 \quad \text{(Eq. 1)}$$

and $$F_3=D_1F_1/D_3 \quad \text{(Eq. 2)}$$

where $D_1$ is the diameter of backing roller 14, $F_1$ is the rotational frequency of backing roller 14 (equals the rotational frequency F of drive roller 50), $D_3$ is the diameter of CCR cover 28, and $F_3$ is the rotational frequency of CCR cover 28.

Further, $$D_2F_2=D_4F_4 \quad \text{(Eq3)},$$

and $$F_4=D_2F_2/D_4 \quad \text{(Eq. 4)}$$

where $D_2$ is the diameter of driver roller 50, $F_2$ is the rotational frequency of driver roller 50

$D_4$ is the diameter of CCR driver roller 50', and $F_4$ is the rotational frequency of CCR driver roller 50'.

Since the frequency of oscillation $F_o$ is the difference between the rotational frequencies of the backing roller and the CCR shell, then $$F_0=F_3-F_4=D_1F_1/D_3-D_2F_2/D_4 \quad \text{(Eq. 5)},$$

but since $F_1=F_2$, $$F_0=F_1(D_1/D_3-D_2/D_4) \quad \text{(Eq. 6)}$$

Further, since backing roller 14 and driver roller 50 rotate about a common axis, as do CCR shaft 24 and CCR driver roller 50', then $$D_1+D_3+W=D_2+D_4 \quad \text{(Eq. 7)}$$

where W is the thickness of the substrate 18.

EXAMPLE 1

What is the oscillation frequency of the barrel cam if $D_1=D_3=6.00$ inches, $D_1=5.90$ inches, $D_4=6.09$ inches, W=0.01 inches, and $F_1=500$ rpm?

By Eq. 6, $F_0=16$ cycles per minute.

EXAMPLE b 2

What must be the diameters $D_2$ and $D_4$ of driver rollers 50 and 50', respectively, for a barrel cam oscillation frequency $F_0$ of 1 cycle per minute, given that $D_1=D_3$ =6.000 inches, W=0.005 inches, and $F_1$=500 rpm?

By Eqs. 6 and 7, $D_2$=5.994 or 6.006 inches, and $D_4$=6.006 or 5.994 inches, since the barrel cam can advance or retard shaft 24 with respect to shell 26 with equal effect in either direction.

In some applications involving relatively low frequencies of rotation and/or relatively high values of frequency of oscillation, first and second driving rollers 40,44' may be of substantially the same diameter and may be toothed as meshing gears having slightly different numbers of gear teeth. Although the pitch of the teeth is, therefore, slightly different between the two gears, the number of teeth on the gears can be large enough that the difference is lost in the tolerances. In this case, the gear having fewer teeth rotates slightly faster than the gear having more teeth, the relative rotational difference being equal to the difference in numbers of teeth.

EXAMPLE 3

If $D_2$ =$D_4$, and $F_2$ =160 rpm, and drive roller 50 has 160 teeth, then drive roller 50' must have either 159 or 161 teeth to cause shaft 24 to rotate once per minute within shell 26 ($F_0$=1).

Figure 5:
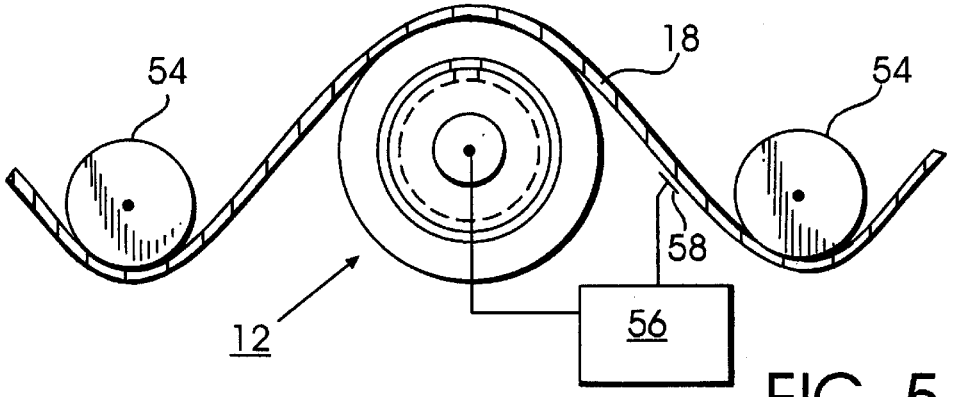
FIG. 5 is an elevational view of a barrel-cam CCR in accordance with the invention, showing the web being cleaned by contact with a CCR in a free conveyance span without a backing roller.

A barrel-cam contact cleaning roller 12 in accordance with the invention may also be mounted for cleaning a web substrate on a free span thereof, without resort to a backing roller, as shown in FIG. 5. The web is driven around the CCR and adjacent idler rollers 54 by any drive means well-known to those skilled in the web conveyance art. The linear velocity of the web dictates the rotational frequency of CCR shell 26. A separate roller drive means including a controller 56 senses the web velocity via sensor 58 and drives the CCR shaft 24 at a rotational frequency determined by the above equations to provide a desired frequency of oscillation. Several such independent means of controllably driving a barrel cam roller are disclosed in the above-cited patent references.

Figure 6:
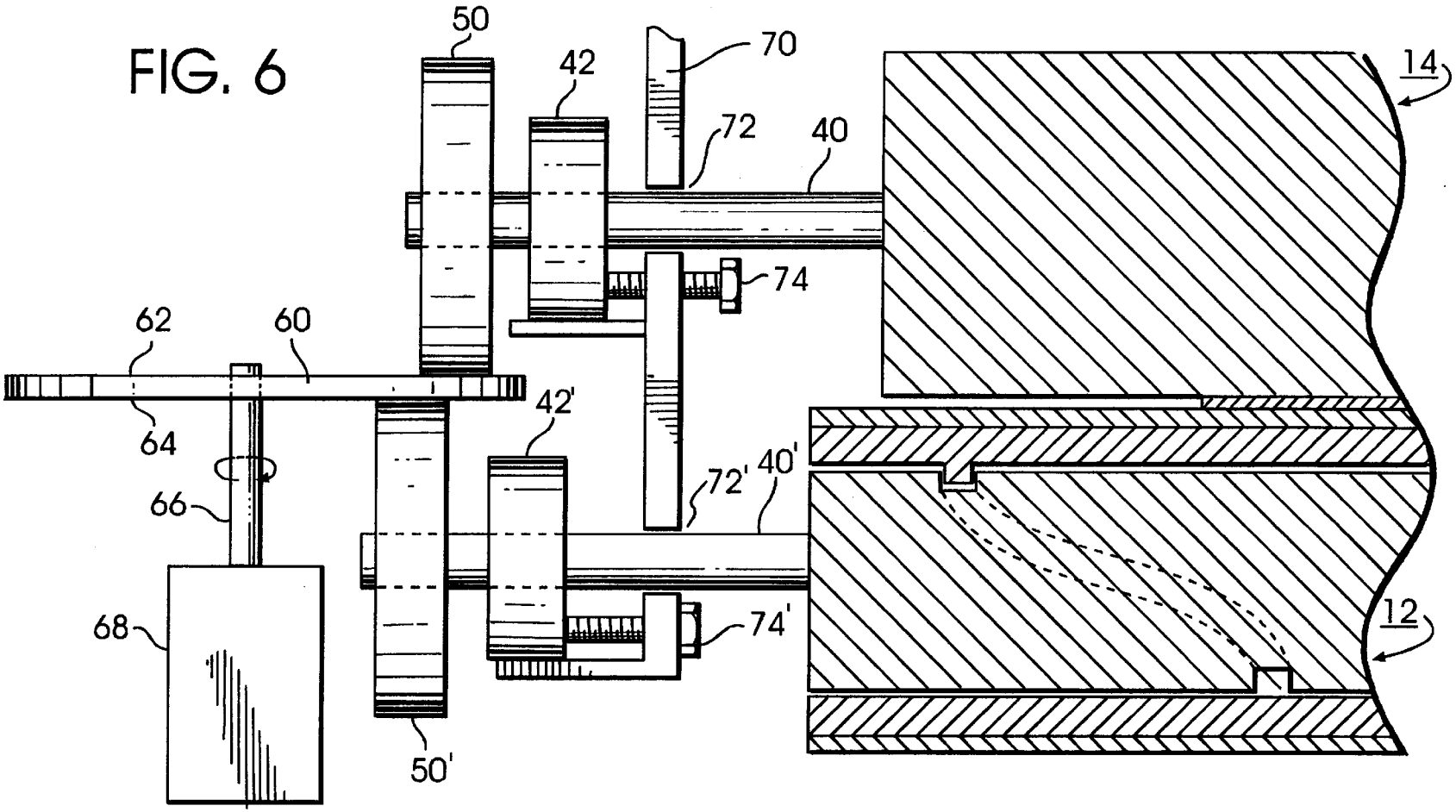
FIG. 6 is a view like that shown in FIG. 2, showing apparatus means for varying independently the rotational frequencies of the barrel cam and the backing roller.

Referring to FIG. 6, an oscillable nipped CCR as shown in FIGS. 2–4 may be adapted to vary the frequency of oscillation as desired. Diameters $D_2$ and $D_4$ have been reduced slightly to $D_2'$ and $D_4'$ of drive rollers 50 and 50', respectively, to accommodate a planar drive wheel 60 therebetween having an axis 62 orthogonal to the axes of shafts 40 and 40'. Wheel 60 is provided with high traction surfaces on both its upper 62 and lower 64 sides for frictionally driving rollers 50 and 50' simultaneously in counter-rotation and is connected via a drive shaft 66 to a controllable drive motor 68 (conventional drive speed controls not shown). Machine frame 70 slidably supports bearing mounts 42 and 42' and is provided with apertures 72, 72' for free passage and rotation of shafts 40 and 40'. Adjustment screws 74, 74' are disposed in threaded bores in frame 70 for translating bearing mounts 42, 42', shafts 40, 42', and hence backing roller 14 and CCR 12 axially of each other. Adjustment of screws 74,74' changes the radial locations of drive rollers 50,50' on their respective upper and lower drive surfaces of planar drive wheel 60 and thereby changes their rotational frequencies. The screws may be adjusted as desired to provide specific values of $F_2$ and $F_4$ and thereby a desired value of $F_0$ in accordance with Equations 1–7.

From the foregoing description it will be apparent that there has been provided an improved oscillable contact cleaning roller, wherein oscillation is imparted by a barrel cam within the contact cleaning roller. Variations and modifications of the herein described oscillable contact cleaning roller, in accordance with the invention, will undoubtedly suggest themselves to those skilled in this art. Accordingly, the foregoing description should be taken as illustrative and not in a limiting sense.

What is claimed is:

1. A contact cleaning roller system for removing particles from a substrate being rolled in contact with the contact cleaning roller, comprising:

a) a cylindrical shell having an inner surface and an outer surface, said outer surface including a tacky material for transferring and retaining particles from said substrate;

b) a shaft having a cylindrical outer surface and being slidably disposed in close-fitting proximity within said cylindrical shell, one of said shell inner surface and said shaft outer surface being provided with a groove incised into and extending around the periphery of said surface between a first axial position and a second axial position to define a cam and the other of said shell inner surface and said shaft outer surface being provided with a protrusion extending into said groove to define a cam follower whereby relative rotation between said cylindrical shell and said shaft causes said shell to be oscillated axially of said shaft between said first axial position and said second axial position.

2. A contact cleaning roller system in accordance with claim 1 wherein said substrate is wrapped through a wrap angle around said contact cleaning roller shell.

3. A contact cleaning roller system in accordance with claim 1 further comprising a backing roller in nipped relationship with said outer surface of said contact cleaning roller shell, a path of said substrate passing therebetween through said nip.

4. A contact cleaning roller system in accordance with claim 3 further comprising:

a) a shaft coaxial with said backing roller for rotation thereof and extending from an end thereof; and b) a shaft extension coaxial with said contact cleaning roller shaft.

5. A contact cleaning roller system in accordance with claim 4, further comprising:

a) a first controllable drive means for rotating said backing roller at a first frequency; and b) a second controllable drive means for rotating said shaft at a second frequency.

6. A contact cleaning roller system in accordance with claim 4, further comprising:

a) a first drive roller disposed on and for rotation with said backing roller shaft; and b) a second drive roller disposed on and for rotation of said contact cleaning roller shaft extension for rotation of said contact cleaning roller shaft.

7. A contact cleaning roller system in accordance with claim 6 wherein said first and second drive rollers are in nipped relationship to each other.

8. A contact cleaning roller system in accordance with claim 6 wherein said first and second drive rollers are provided with gear teeth on their respective peripheral surfaces, said gear teeth of said respective rollers being in meshing relationship.

9. A contact cleaning roller system in accordance with claim 7 wherein said backing roller has a first diameter $D_1$, said first drive roller has a diameter $D_2$, said cylindrical shell has a diameter $D_3$, said second drive roller has a diameter $D_4$, and said substrate has a thickness W, and wherein $D_2+D_4=D_1+D_3+W$.

10. A contact cleaning roller system in accordance with claim 6, further comprising means for synchronously driving said first and second drive rollers.

11. A contact cleaning roller system in accordance with claim 10 wherein said driving means includes a planar drive wheel disposed in a plane parallel to the axes of said backing roller shaft and said contact cleaning roller extension shaft and in mating contact on a first surface thereof with the periphery of said first drive roller and on a second and opposite surface thereof with the periphery of said second drive roller, drive wheel being disposed on a driven shaft for rotation to cause said first and second drive rollers to be rotated.

12. A contact cleaning roller system in accordance with claim 10, further comprising means for displacing said first drive roller a first distance along a radius of said drive wheel and for displacing said second drive roller a second distance along a radius of said drive wheel to vary the rotational frequencies of said first and second drive rollers.

13. A contact cleaning roller system in accordance with claim 12 wherein said first distance is unequal to said second distance.

* * * * *